United States Patent [19]

Hattori

[11] 3,990,130

[45] Nov. 9, 1976

[54] AIRTIGHT SLIDE FASTENER

[76] Inventor: Takao Hattori, 13-3, 3 chome, Minami cho, Maebashi, Gumma, Japan

[22] Filed: Apr. 29, 1975

[21] Appl. No.: 572,870

[30] Foreign Application Priority Data

May 15, 1974 Japan ..... 49-53218

[52] U.S. Cl. ..... 24/205.1 R; 24/205.11 R

[51] Int. Cl.[2] ..... A44B 19/32; A44B 19/36

[58] Field of Search ..... 24/205.1 R, 205.11 R

[56] References Cited

UNITED STATES PATENTS

| | | | |
|---|---|---|---|
| 2,193,827 | 3/1940 | Marinsky | 24/205.11 R |
| 2,296,468 | 9/1942 | Feist | 24/205.1 R |
| 2,335,147 | 11/1943 | Heimann | 24/205.11 R |
| 2,753,609 | 7/1956 | Gossner | 24/205.11 R |
| 2,841,851 | 7/1958 | Vanamburg | 24/205.1 R |
| 2,932,872 | 4/1960 | Geissmann | 24/205.11 R |

FOREIGN PATENTS OR APPLICATIONS

| | | | |
|---|---|---|---|
| 76,248 | 1947 | Czechoslovakia | 24/205.1 R |
| 650,599 | 2/1951 | United Kingdom | 24/205.1 R |
| 922,072 | 3/1963 | United Kingdom | 24/205.1 R |

*Primary Examiner*—Paul R. Gilliam
*Attorney, Agent, or Firm*—Flynn & Frishauf

[57] ABSTRACT

Two paralleled fastener tapes are provided on their front and back surfaces with engagement pieces to close and open the tapes, as well as a locking device to fix the slider having inversed V shaped arms at one end. On both sides of the slider are provided hooks to close the arms by engaging the tips of the arms of the locking device, so that a complete airtightness is maintained in the airtight slide fastener when the fastener is closed against any of the pressures applied from the directions of the back or the front of the tapes.

18 Claims, 18 Drawing Figures

AIRTIGHT SLIDE FASTENER

BACKGROUND OF THE INVENTION

This invention concerns an airtight slide fastener. These type of fasteners are widely used in daily life because of the simple closing and opening mechanism by moving the slider, but they are defective in that they lack the airtightness as only plural pieces provided on the tapes engage with each other to effect closure and the tapes on which the engaging pieces are provided do not contact each other.

If a slide type fastener which would maintain complete airtightness were to be developed and used in containers or clothing comprising any kind of treated cloth or rubber sheet for keeping airtightness, then this would prove vastly meritorious in the industry. Many attempts have been made heretofore in this regard. A simple example of such prior attempts is a sliderless fastener, utilizing the flexibility of plastic materials. This prior device has a female groove on one edge of the plastic tape and a male ridge on the other edge for mutual engagement. However, while this fastener may remain airtight so long as the male part stays within the female part, the two are quite easily separated when a slight force is applied thereto. Thus, their use is limited to a very narrow field, such as for bags receiving merchandise.

Opening and closing of slide fasteners is conventionally effected by causing engagement of a plurality of engagement pieces or separation thereof. Therefore, it will be possible to maintain airtightness if the tapes on which the engaging pieces are provided can also be engaged in a tight-seal fashion at the time said engaging pieces are engaged with each other. However, the problem still remains that, if the fastener tapes of such a structure were to be closed and complete airtightness were to be obtained as the two tapes are engaged with each other, there would still be a slider at one end of the tape and the area around the slider would not be airtight, since the engagement of the tapes at this particular area would not be perfect.

In order that a complete airtightness of the slide fastener be obtained, it is necessary to provide the end of the tape with a special structure which would cause that part of the tapes that come within the slider to strongly adhere to the leader of the slider after moving the slider to close the fastener tapes.

SUMMARY OF INVENTION

One feature of an airtight slide fastener of the present invention is to provide a plurality of engagement pieces on the front and the back of the tapes in order that the pair of the fastener tapes are closed as the engagement pieces on both the front and the back of the tapes engage each other and in order that the packings provided on the respective tape edges as they are closed would tightly adhere to each other to maintain the airtightness. Another feature of the present invention resides in that the slider which effects opening and closing of the fastener tapes has a teardrop shaped leader and an angular hook on both sides of the outer surface. On the other side of the fastener tape is provided a slider lock with inverse V shaped arms to effect the closing and the opening of the fastener tapes so that the slider hook which comes to the said end of the fastener would engage with the arm of the slider lock to close the same, and the end of the tape would adhere to the slider leader as if embracing the outer surface thereof, thereby maintaining airtightness between the fastener tape and the slider.

BRIEF DESCRIPTION OF DRAWINGS

The purposes and advantages of the present invention will further become clear from the following description of the invention in conjunction with the attached drawings, in which.

DESCRIPTION OF PREFERRED EMBODIMENT

Figure 1:
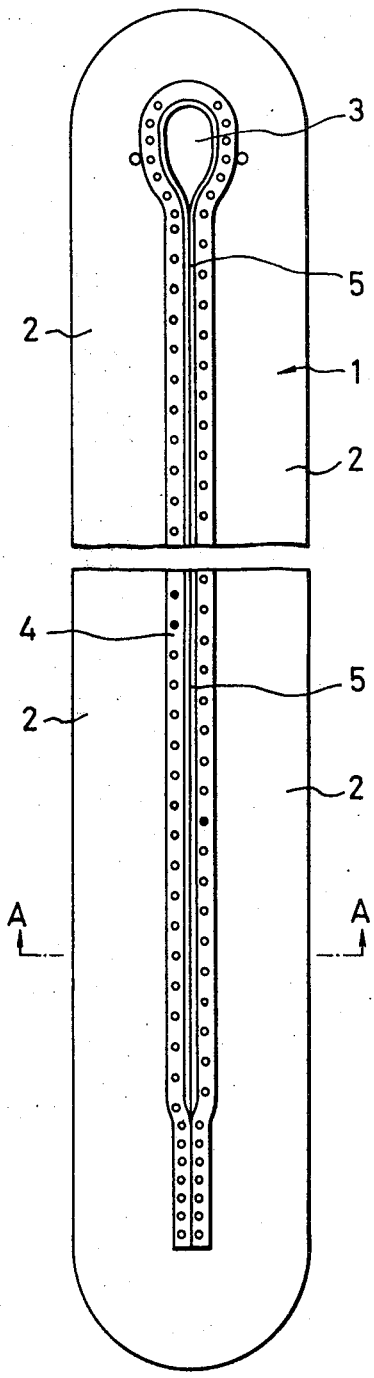
FIG. 1 is a plane view of the fastener tape.
Figure 3:
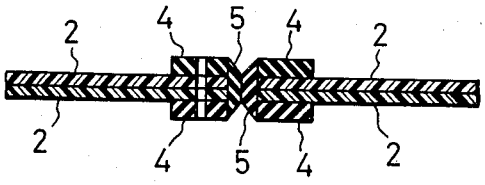
FIG. 3 is a cross section along line A — A of FIG. 1.

As shown in FIG. 1, the fastener tape comprises tape material 1 made from elastic and sturdy woven or nonwoven materials dipped with synthetic rubber or plastic resin to make the material airtight, and two airtight tapes 2 are to be provided in parallel at the center of the tape material 1 by cutting a slot along the longitudinal direction leaving the two ends of the tape uncut. The tape material 1 comprising the airtight tapes 2 should, preferably, as shown in FIG. 3, be prepared by aligning the two pieces of the same materials together and adhering them. On one end of the slot on the airtight tape 2 is provided a teardrop or wedge shaped void 3. When the airtight tapes 2 contact with each other at the slot, then a space at this point 3 is formed without the bordering lines contacting with each other. On the front and back sides of the bordering edges along the slot of the airtight tapes 2 are placed thin reinforcement tapes 4 formed of natural or synthetic fibers and dipped into elastic materials such as synthetic rubber, etc. On the contacting edges of the airtight tapes 2 of which thickness is increased by the reinforcement tapes 4 are adhered packings 5 having a cross section like a hill as shown in FIG. 3. As these packings 5 contact with each other, the airtightness of the airtight tapes 2 becomes fully complete.

Figure 4:
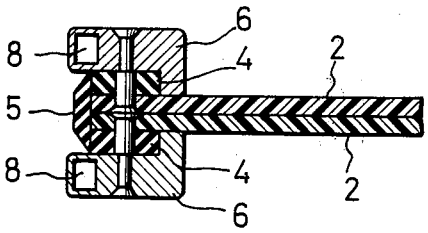
FIG. 4 is a cross section along line B — B of FIG. 2.

The reinforcement tapes 4 are provided, except for both ends thereof, with a plurality of engagement pieces 6. The present invention, as shown in FIGS. 4 and 5, is in part characterized in that a pair of engagement pieces 6 are provided on the front and the back surfaces of the reinforcement tape 4. Each of the engagement pieces 6 is positioned symmetrically on both sides of respective reinforcement tapes 4 with equal intervals and in such a position that the hub 7 and the end having a concave part beneath the hub 7 would project slightly beyond the packings 5, and they are fixed on the reinforcement tapes 4 by adhesive or a rivet 9. The embodiment shown in the attached drawings has these engagement pieces 6 fixed by rivets 9. Each of the rivets 9 has a flange 10 at its center. When the flange 10 is adhered to the two surfaces of the airtight tapes 2, the rivet is preliminarily pulled through the airtight tapes and the reinforcement at both ends thereof, over which are inserted the engagement pieces 6 in such manner that they are fixed as both ends of the rivet are screwed. The engagement pieces 6 may be made from phosphor bronze, brass, synthetic resin, etc. and the rivets 9 may be made from copper, bronze, synthetic resin, etc.

Figure 7:
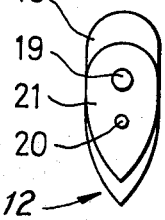
FIG. 7 is a plane view of a leader to be provided on the slider.
Figure 8:
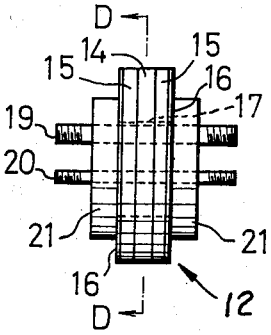
FIG. 8 is a side view of the leader.
Figure 9:
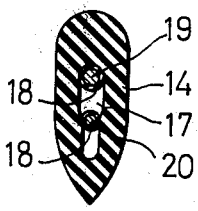
FIG. 9 is a cross section along line D — D in FIG. 8.
Figure 10:
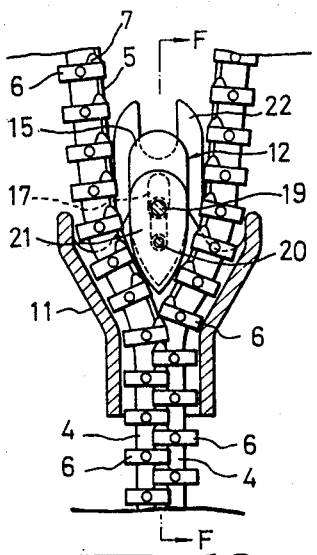
FIG. 10 is a cross section along line E — E in FIG. 6.
Figure 11:
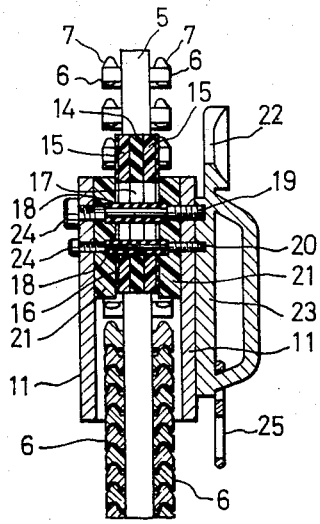
FIG. 11 is a cross section along line F — F in FIG. 10.

The slider 11 is to open and close the airtight tape 2 is provided over the two sides of the reinforcement tape 4 in such a fashion as to embrace the engagement pieces 6 on the surface of the reinforcement tape 4 as shown in FIGS. 3 and 11. At the rear end of the slider, as shown in FIG. 10, each of the engagement pieces 6 provided on both sides of the reinforcement tapes 4 engage each other. The slider 11 in its center has a teardrop shaped or wedge shaped leader 12 (see FIGS. 7 and 8) which corresponds to the shape of the void 3 provided at one end of the airtight tape 2, and a hook 13 protruding equally in an angular fashion at both ends of the edge. The leader 12 comprises a mobile piece 15 which sandwiches the teardrop wedge shaped rubber piece 14 with the two synthetic resin pieces of the identical shape on both sides and the fixed piece 21 made of synthetic resin arranged on the outside of the mobile piece 15. The mobile piece 15 has a sheet packing 16 adhered on the surface thereof and a slot 17 having a tapered lower end is provided at its center. Two screws or axes 19, 20 having different thicknesses and a sleeve shaped packing 18 placed inside their respective center are placed in parallel through the slot 17, and the ends of the screws are attached at their two ends by passing their ends through the two synthetic resin fixed pieces 21 arranged so that they would be in close contact with the surface of the sheet packing 16 of the leader 12. Accordingly, the mobile pieces 15 can move for the length of a part of the slot 17 between the fixed pieces 21 which fix the ends of the two screws while maintaining the airtightness of the fixed pieces with the sheet packing 17.

The leader 12 thus constructed is intercepted between the two ends in the two sliders 11, as shown in FIG. 11, and the two ends of the two screws 19, 20 of the leader 12 pass through the sliders 11 respectively so that one end of the two screws is screwed to the fixed part 23 of the connecting hook 22 arranged on the surface of the slider 11, while the other ends of the two screws protruding from the surface of the slider 11 are screwed to nuts 24 respectively. The connecting hook 22 has a concave bowl shaped surface with a U-shaped notch at the end thereof.

Figure 2:
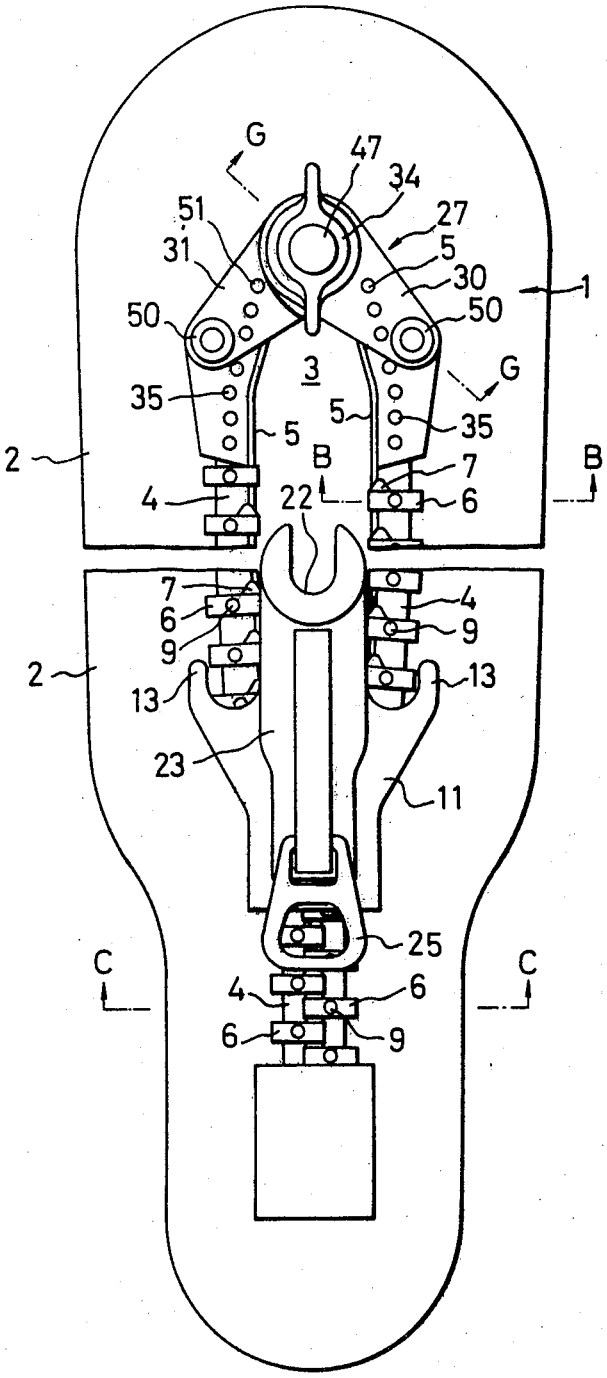
FIG. 2 is a partially fragmentary plane view of the slide fastener tape in accordance with the present invention.

As seen in FIG. 2, the teardrop shaped void 3 is provided with a slider lock 27 to hold the slider 11 in its position as the fastener is closed. The slider lock 27 has a pair of inversed V-shaped arms, 30, 31, 32 and 33

Figure 6:
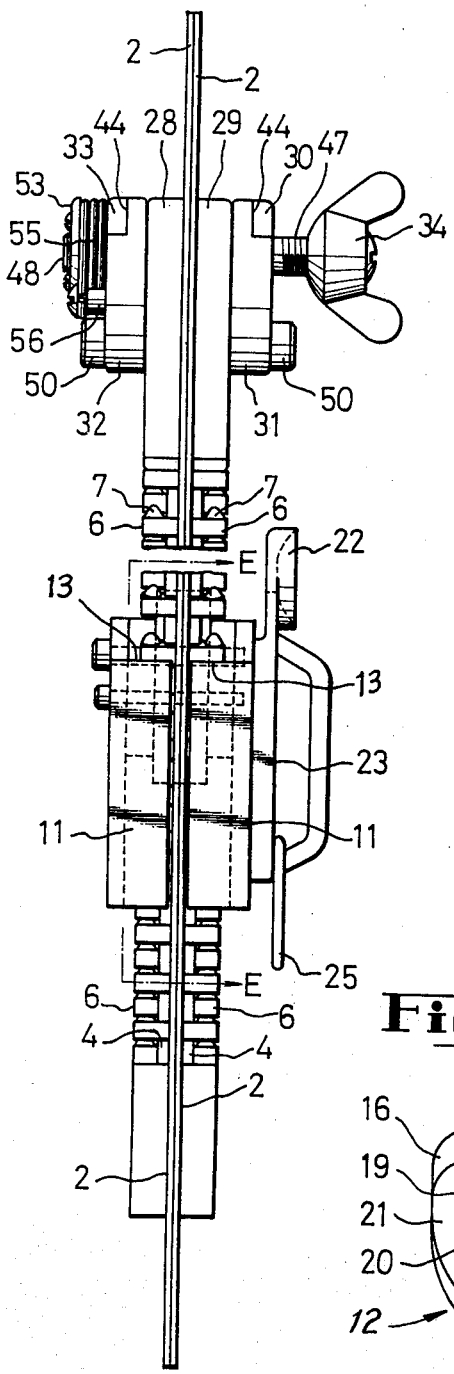
FIG. 6 is a side view of a slide fastener.
Figure 12:
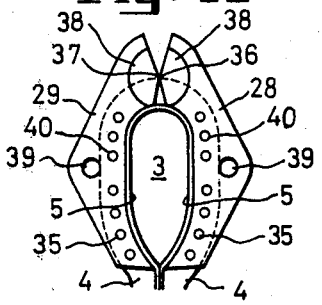
FIG. 12 is a plane view of the intercepting pieces for the slider lock to be provided on one end of the fastener tape.
Figure 13:
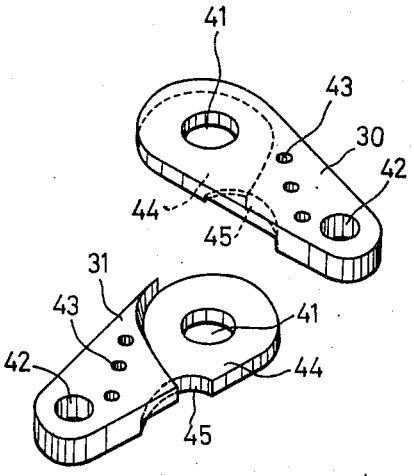
FIG. 13 is a perspective view of the arms of the slider lock.
Figure 14:
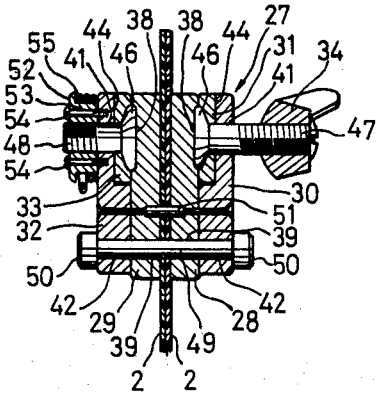
FIG. 14 is a cross section along lines G — G in FIG. 2.

(see FIG. 6) to press the intercepting pieces 28, 29 upon the outside faces of the leader 12 respectively by the engagement of the intercepting pieces 28, 29 and the hooks 13 provided on both sides of the slider 11 via axis, the intercepting pieces 28, 29 acting to press the bordering edges of the void 3 to the outside surfaces of the leader 12 in the slider 11, and also a butterfly nut 34 which connects the connecting hook 22 at the center of the slider 11 with the slider lock 27 itself. The intercepting pieces 28, 29 comprise, as shown in FIG. 12, a pair of symmetrical metal plates to be attached to the reinforcement tapes 4 at the border of the void 3 by means of a rivet 35. On the back side of the intercepting pieces are arranged another pair of similar intercepting pieces 28, 29. The intercepting pieces 28, 29 have gradually sloped projecting parts at the end parts thereof, at the top of which, 36, 37 the intercepting pieces 28, 29 contact each other, and the said intercepting pieces 28, 29 being mobile or movable in the directions of right and left. The contacting points 36, 37 of the intercepting pieces 28, 29 are provided with a circular concave part 38, and a small bore 40 for letting the rivet through and the hole 39 for the screw are provided at the center of the intercepting pieces 28, 29.

Arms 30, 31 and 32, 33 comprising respectively of the wedge shaped metal sheet with rounded corners are attached onto the intercepting pieces 28, 29 in the inverted V-shape. Another pair of arms 32, 33 are attached respectively to the front and the back surfaces of the intercepting pieces 28, 29. Arms 30, 31, 32 and 33 are provided on their both ends with axial holes 41, 42 and a small bore 43 between the axial holes to connect with the small bore 40 of the intercepting pieces. On one end of the arm where the axial hole 41 is provided is a contacting face 44 with its thickness reduced in half so that the other end of respective arms where the axial hole 42 is would be on the same plane when the arms 30, 31 are held together with the arms 32, 33. The respective pairs of arms 30, 31 and 32, 33 are placed together at the said contact faces 44 and arranged on the surface of the intercepting pieces 28, 29 through the screws 47, 48 having flanges or heads 46 on one end thereof so that the flanges on respective screws would be placed within the circular concave part 38 of the intercepting pieces 28, 29. In the other hole 42 of the arms 30, 31 are inserted bolts 49 respectively, the end of which are inserted into the axial hole 39 of the intercepting pieces 28, 29 and the axial hole 42 of the opposite arms 32, 33, and a nut 50 is screwed on the end of the said bolts protruding from through the axial holes 42 of the arms, 32, 33. There are rivets 51 inserted through the small bores 43 of the arms 30, 31, the small bores 40 of the intercepting pieces 28, 29 connecting thereto and the small bores 43 of the opposite arms 32, 33 and the both ends of the rivets are caught like a plate. Accordingly one of the arms 30 on the front side and another one 32 on the back side are connected into one with the bolt 49 and the rivet 51 via two facing intercepting means 28, 29 while the other arm 31 on the front side and the other arm 33 on the back side are also connected with each other in the same fashion by the bolt 49 and the rivet 51 via the intercepting pieces 29, 28 facing each other.

Figure 16:
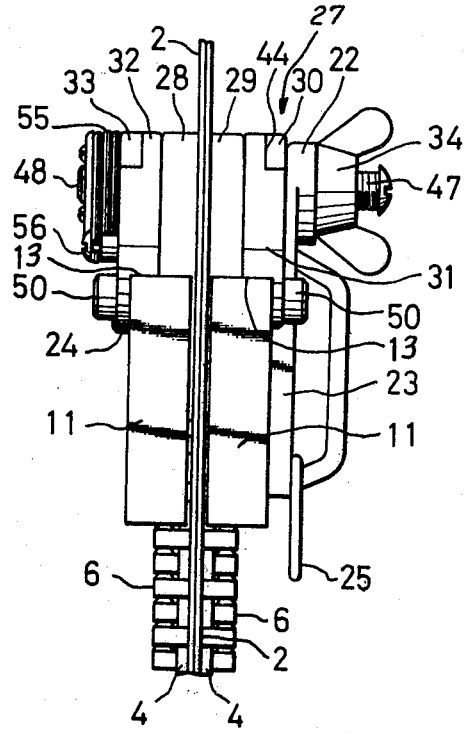
FIG. 16 is a side view of the complete engagement of the slider and the slider lock.

The screw 47 inserted through the axial bore 41 of the arms 30, 31 is longer than the screw 48 inserted through the axial bore 41 of the arms 32, 33 and a butterfly nut or wing-nut 34 is screwed on the threaded end. As the connecting hook 22 in the slider 11 is encased in the screw 47 and tightens the screw nut 34, the nut 34 connects the hook 22 to the slider lock 27 as shown in FIG. 16. Around the screw 48 inserted through the axial hole 41 of the arms 32, 33 on the back side is inserted a boss 53 having a flange 52 at the end, the boss 53 being fixed to the surface of the arm 32 by a screw. Around the boss 53 is wound a coil spring 55 and the spring 55 is fixed at its two ends to a pair of pins 56 protruding in the center of the arms 32, 33. Accordingly, the arms 32, 33 are constantly being applied with a force to open outwardly from the axis by the coil spring 55, and the arms 30, 31 on the front side connected to these arms 32, 33 via bolt 49 and the rivet 51 are also subjected to the same action. Naturally, the intercepting pieces 28, 29 positioned between the said arms 30, 31 and 32, 33 are also subjected to the same action and the void 3 is opened widely so as to accept the leader 12 of the slider 11 smoothly.

Figure 5:
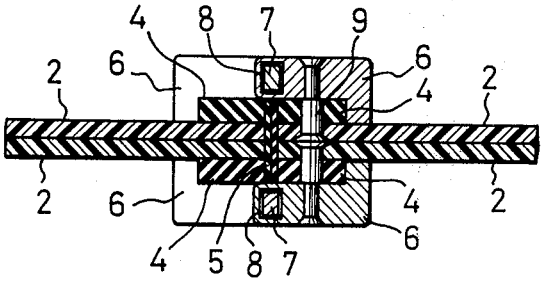
FIG. 5 is a cross section along line C — C in FIG. 2.
Figure 15:
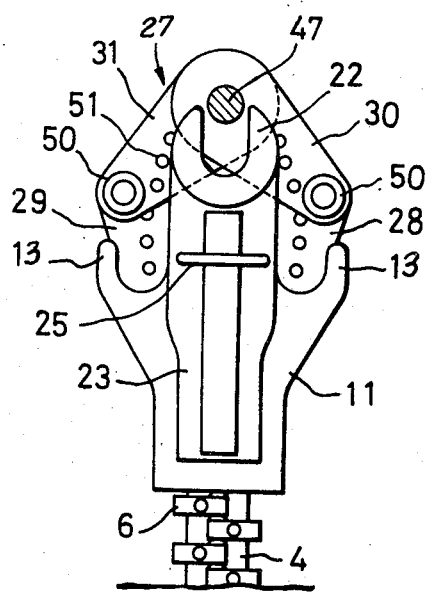
FIG. 15 is a plane view showing the cross section of one part of the fastener immediately before the slider becomes engaged with the slider lock.
Figure 17:
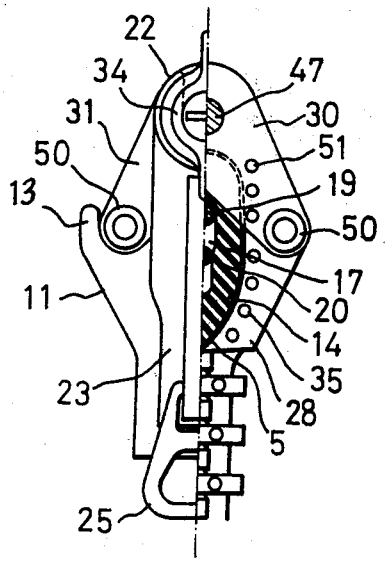
FIG. 17 is a plane view showing the cross section of a part of that shown in FIG. 16.
Figure 18:
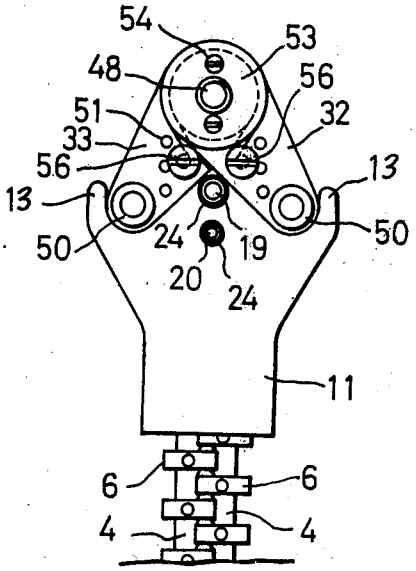
FIG. 18 is a back view of the arrangement of FIG. 16.

The airtight fastener in accordance with the present invention is constructed as above mentioned. As shown in FIG. 10, the slider 11 is pulled upwardly as shown in the drawing when the fastener is closed and the engaging pieces 6 on four sides (left and right, back and front) of the reinforcement tape 4) at the rear end of the slider 11 become engaged. The hill shaped packings 5 provided at the end face of the reinforcement tape 4 become contracted as the engagement pieces 6 become engaged, as shown in FIG. 5. The airtight tapes on both sides 2 are pressed together tightly to maintain the airtightness. As shown in FIG. 10, the slider 11 moves upwardly and the rubber and plastic pieces 14, 15 of the leader 12 in the slider 11 are raised upwardly for the portion of the length of the slot 17. Thus the rear screw 20 contacts the lower end of the slot 17. The slider 11 is pulled upwardly in this manner and closes the airtight tapes 2. As the slider 11 moves to the proximity of the void 3 at the upper end of the airtight tapes, the arms 30, 31 and 32, 33 which had been open by the spring 55 move around the screws 47, 48 in a direction to narrow the void 3. Then, the end of the hooks 13 on both sides of the slider 11 contact the lower ends of the arms 30, 31 and 32, 33. When the slider 11 is moved further, the lower ends of the said respective arms slide into the curved parts of the hooks 13 to further move the arms 30, 31 and 32, 33 toward the center axis of the fastener. Thus, the intercepting pieces 28, 29 connected to the arms 30, 31 and 32, 33 via bolt 49 act to narrow the void 3. When the fastener reaches this state, the leader 12 in the slider 11 is already within the void 3 and the mobile piece 15 of the leader at one end thereof contacts the innermost part of the void before the slider 11 is completely connected to the slider lock 27 as shown in FIG. 15, since the mobile piece 15 of the leader is lifted upwardly by the length equivalent to one portion of the slot 17. When the slider 11 reaches its final position, the mobile piece 15 of the leader 12 is already in the stationary position and only the slider 11 to be connected by the screws 19, 29 alone moves along the slot 17 of the mobile piece 15 and the screw 19 contacts the upper end of the slot 17 as shown in FIG. 17. Into the lower ends of the arms 30, 31 and 32, 33 are completely inserted the curved part of the hook 13 of the slider 11. Therefore, the intercepting pieces 28, 29 cause the packing 5 on the inner surface of the void 3 to face the outer peripheral surface of the mobile piece 15 of the leader 12. The connecting hook 22 in the center of the slider 11 is already embracing the screw 47, the hook 33 is fixed on the surface of the arm 31 as the butterfly nut 34 is tightened and the slider 11 is connected to the slider lock 27. The void 3 of the airtight tapes closely contacts the slider leader 12 via the packing 5 within the void and the part other than the void 3 is tightly sealed as the packings 5 of the reinforcement tape 4 are closely sealed by the engagement of the engaging pieces 6.

To open the fastener, the butterfly nut 34 is loosened and the slider 11 is pulled down. Mobile piece 15 having a slot 17 provided on the leader takes an important role in the opening of the fastener. If the leader 12 did not have the mobile piece 15 which moves along the slot but was fixed to the slider 11, then a force working to separate the slider 11 from the slider lock 27 would cause the lower end of the leader 12 inserted deep inside the void 3 to force open the engagement pieces located immediately beneath the void and damage the leader 12, thus impairing the airtightness. However the provision of a mobile piece 15 movably along the slot 17 on the leader in accordance with the present invention would cause the movement of the slider 11 slightly downward without moving the mobile piece 15 as the force to separate the slider 11 from the slider lock 27 is applied, and the screw 20 contacts the lower end of the slot 17 as shown in FIG. 10. The downward movement of the slider 11 would open the arms 30, 31 and 32, 33 outwardly by the force of the spring 55 as the lower ends thereof are lifted from within the curved part and cause the intercepting pieces 28, 29 to separate the packing 5 of the void 3 from the leader 12. This movement accompanies a slight disengagement of the engagement pieces 6 located immediately beneath the void 3 independent of the movement of the leader 12. Partial disengagement of the pieces 6 immediately below the void 3 will encourage the disengagement of all the engagement pieces by the leader as the slider is pulled down. By further pulling down the slider, the rear end of the fixed piece 21 on the front and back sides of the mobile piece 15 on the leader 12 would disengage the respective engagement pieces successively as shown in FIGS. 10 and 11.

In the airtight slide fastener in accordance with the present invention, the reinforcement tapes 4 having packings 5 on the periphery of the airtight tapes 2 are provided and the engagement pieces 6 are also provided on the surface and the back of the reinforcement tapes. Thus, a complete airtightness is obtained by the close sealing of the packings 5 as the engagement pieces 6 engage with each other. On the upper ends of the airtight tapes 2, there are provided the void 3 and the intercepting pieces 28, 29 closely embracing the outer sides of the slider leader by the movement of the arms of the slider lock although there are provided no engagement pieces. Therefore, it is possible to secure the airtightness at the part where the slider 11 is positioned. Thus, the slider fastener in accordance with the present invention is advantageous in that it exerts sufficient strength toward the pressures that are applied from the surface or the back of the fastener as the fastener is closed.

What we claim is:

1. An airtight slide fastener comprising:

a tape including a pair of engageable tape members, each tape member having edges which are adapted to confront each other;

a plurality of engagement pieces on the front and back surfaces of said confronting edges of said tape members;

packings on the contact edges of said confronting edges of said tape members and adapted to be airtightly engaged upon closing of said slide fastener;

a slider slideably coupled to said tape members and engageable with said engagement pieces for opening and airtightly closing said tape members, said slider comprising angularly protruding hooks on both sides thereof and a generally wedge-shaped leader inside thereof;

a slider lock at one end of each of said tape members to engage with respective slider hooks to effect close sealing of said packings with the outer surface of said generally wedge-shaped leader, said slider lock further including a pair of articulated arms forming an inverted generally V-shaped member at least on the outer side of said tape members, each arm being pivotally attached to a respective tape member at an end portion thereof;

said slider including means engageable with said generally V-shaped member in the vicinity of the apex thereof when said slider hooks are engaged with said slider lock; and said slider lock further including means for fixedly and substantially non-resiliently locking the engaged slider and generally V-shaped member in the engaged position to maintain the airtight seal of said tape members with said generally wedge-shaped leader.

2. An airtight slide fastener according to claim 1, wherein said generally wedge-shaped leader is generally tear-drop shaped.

3. An airtight slide fastener according to claim 1, wherein said tape comprises:

a first sheet of non-air permeable tape material having a slot cut in the center portion thereof to form said engageable tape members, the both end portions of said non-air permeable tape material being uncut;

reinforcement tapes on the front and back surfaces of said non-air permeable tape material along the periphery of both sides of the slot of the two tape members;

said packings being mounted on the faces of the reinforcement tapes; and said engagement pieces being mounted on the front and back surfaces of the reinforcement tapes on both sides and being mutually engageable with each other.

4. An airtight slide fastener according to claim 3 comprising a plurality of rivets passing through said tape with the opposite ends thereof protruding from the front and back, respectively, of said tape, and wherein said engagement pieces are mounted over the two ends of respective rivets, said engagement pieces being tightened over the two ends of said rivets to securely fix each engagement piece to the respective reinforcement tape.

5. An airtight slide fastener according to claim 3 wherein said tape comprises a void at one end of said slot for embracing said slider leader.

6. An airtight slide fastener according to claim 1 wherein said tape has a void provided at one end of said pair of engageable tape members for embracing said slider leader.

7. An airtight slide fastener according to claim 6 wherein said slide leader has packings thereon to mutually engage the peripheral portions of said void in said tape.

8. An airtight slide fastener according to claim 6, wherein said slider lock comprises intercepting pieces at the periphery of said void at one end of said airtight tapes to selectively open and close said void at the front and the back, and said generally V-shaped member at the outer side of the respective intercepting pieces being connected to said intercepting pieces via further respective elongated members, the corresponding ends of said V-shaped member being aligned by said further elongated members so as to be engageable with said slider hooks on respective sides of said slider.

9. An airtight slide fastener according to claim 8 wherein said slider lock comprises generally hill-shaped portions at the innerside of one end of each of said intercepting pieces, the intercepting pieces on both sides thereof contacting each other at the top of said hill-shaped portions.

10. An airtight slide fastener according to claim 1 wherein said slider has two generally wedge-shaped leaders, each engageable with engagement pieces on respective opposite sides of said tape.

11. An airtight slide fastener according to claim 1, wherein said slider is further provided with a generally U-shaped connecting hook at substantially the center of one face of the slider.

12. An airtight slide fastener according to claim 1, wherein said generally wedge-shaped leader provided within said slider comprises:

two fixed, mutually facing, spaced apart pieces;

at least two elongated members fixed to said two pieces and passing therebetween; and a mobile piece longer than the said fixed pieces and having a slot in substantially the center thereof, said mobile piece being mounted in the space between said two fixed pieces with said two elongated members passing through the slot therein, said mobile piece being mobile along the slot thereof between said fixed pieces for a portion of one part of said slot.

13. An airtight slide fastener according to claim 12, wherein said mobile piece of said leader comprises two pieces of rubber sheets sandwiching one piece of plastic sheet, all of said sheets having substantially the same shape and being adhered together to form a three layer mobile piece.

14. An airtight slide fastener according to claim 12, wherein said mobile piece of said leader has a sheet packing adhered on both surfaces thereof, said mobile piece being in close slidable contact with the inner surfaces of said fixed pieces via said sheet packing.

15. An airtight fastener according to claim 12, wherein said at least two elongated members passing through said slot of said mobile piece and fixed to said fixed pieces at the both ends thereof are provided with respective sleeve shaped packings at the parts thereof passing through said slot of said mobile piece.

16. An airtight slide fastener according to claim 1, comprising inverted generally V-shaped members on the outer and inner surfaces of said tape members, and rivets passing through said tapes and mutually pivotally fixing said inverted generally V-shaped members at the ends thereof.

17. An airtight slide fastener according to claim 1, wherein said leader has a connecting hook on the outer side thereof; and said slider lock includes a screw member at the apex of said inverted generally V-shaped member and pivotally supporting said arms, and a butterfly nut means threadably engaged with said screw member and arranged to receive said connecting hook between said butterfly nut means and said V-shaped member, said connecting hook being fixed by tightening of said butterfly nut means to said V-shaped member to fixedly and substantially non-resiliently maintain said airtight seal of said tape members with said generally wedge-shaped leader.

18. An airtight slide fastener according to claim 1, wherein said slider lock further comprises a further pair of articulated arms forming an inverted generally V-shaped member on the back or inner side of said airtight tapes; an elongated member with a boss thereon axially supporting said inner V-shaped member relative to said tape; a coil spring over said boss; and respective pins connecting both ends of said spring to said intercepting pieces on the left and right on the back surface of said airtight tapes.

* * * * *